US006575507B2

(12) United States Patent
Reddmann

(10) Patent No.: US 6,575,507 B2
(45) Date of Patent: Jun. 10, 2003

(54) POWER-ACTUATED MOTOR-VEHICLE DOOR LATCH

(75) Inventor: Uwe Reddmann, Essen (DE)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 10/233,261

(22) Filed: Aug. 30, 2002

(65) Prior Publication Data

US 2003/0062727 A1 Apr. 3, 2003

(30) Foreign Application Priority Data

Sep. 4, 2001 (DE) ..... 101 43 366

(51) Int. Cl.[7] ..... E05C 3/16
(52) U.S. Cl. ..... 292/216; 292/201
(58) Field of Search ..... 292/216, 201, 292/DIG. 23; 70/204

(56) References Cited

U.S. PATENT DOCUMENTS 5,634,677 A * 6/1997 Buscher ..... 292/216
5,921,595 A * 7/1999 Brackmann ..... 292/216
5,961,163 A * 10/1999 Brackmann ..... 292/201
6,112,564 A * 9/2000 Rathmann ..... 70/279.1
6,213,524 B1 * 4/2001 Bree ..... 292/201
6,390,517 B1 * 5/2002 Ehret ..... 292/201
6,520,548 B1 * 2/2003 Fisher ..... 292/201
6,520,549 B1 * 2/2003 Kalsi ..... 292/216
2001/0030428 A1 * 10/2001 Kunst ..... 292/201
2002/0121784 A1 * 9/2002 Chevalier ..... 292/201
2002/0140237 A1 * 10/2002 Kobayashi ..... 292/201
2002/0167179 A1 * 11/2002 Takamura ..... 292/201

FOREIGN PATENT DOCUMENTS

DE G86 21 592 11/1986
DE 196 50 826 6/1998

* cited by examiner

*Primary Examiner*—Gary Estremsky
(74) *Attorney, Agent, or Firm*—Herbert Dubno; Andrew Wilford

(57) ABSTRACT

A motor-vehicle door latch has a housing, a lock fork pivotal on the housing between open and closed positions, a latch pawl pivotal on the housing and engageable with the fork in the closed position to retain it therein and disengageable from the fork to allow to move from the closed to the open position, and an opening lever coupled to the latch pawl and displaceable between an actuated position displacing the latch pawl out of engagement with the fork and an unactuated position with the latch pawl engageable with the fork. A rotary drive couplable to the opening lever can displace it between its actuated and unactuated positions. Structure engageable between the fork and the opening lever decouples the opening lever from the drive on displacement of the fork from the open to the closed position.

13 Claims, 6 Drawing Sheets

POWER-ACTUATED MOTOR-VEHICLE DOOR LATCH

FIELD OF THE INVENTION

The present invention relates to a motor-vehicle door latch. More particularly this invention concerns a power-actuated motor-vehicle door latch.

BACKGROUND OF THE INVENTION

A power-actuated door latch, for instance used on a motor-vehicle trunk and as described in German patent document 196 50 826 of Bartel and Kleefeldt, has a housing, a lock fork pivotal on the housing between open and closed positions, a latch pawl pivotal on the housing and engageable with the fork in the closed position to retain it therein and disengageable from the fork to allow to move from the closed to the open position, and an opening lever coupled to the latch pawl and displaceable between an actuated position displacing the latch pawl out of engagement with the fork and an unactuated position with the latch pawl engageable with the fork. A rotary drive is coupled to the opening lever for displacing it between its actuated and unactuated positions. German utility model 86 21 592 describes a linear actuator used in such a system. With such a structure a switch is actuated by the vehicle operator to energize the drive and open the latch, normally without requiring any further action to be taken before the door can be pulled fully open or the trunk lid fully raised.

An annoying feature of these systems is that, once the door is released so it can be opened, the drive for the latch continues to rotate so that it can move back into its starting position. Thus after the click produced by the release of the door, there is the grinding sound of the motor and gear train as the drive is returned to its starting position. This starting position must be reassumed so that the latch can be closed again, as if the drive stopped just when it had released the fork, the pawl would be retained in a position spaced from the fork and would not arrest the fork when the door were closed again. Furthermore such latches are often unnecessarily complex.

OBJECTS OF THE INVENTION

It is therefore an object of the present invention to provide an improved power-actuated motor-vehicle door latch.

Another object is the provision of such an improved power-actuated motor-vehicle door latch which overcomes the above-given disadvantages, that is which operates quietly and that is of simple construction.

SUMMARY OF THE INVENTION

A motor-vehicle door latch has according to the invention a housing, a lock fork pivotal on the housing between open and closed positions, a latch pawl pivotal on the housing and engageable with the fork in the closed position to retain it therein and disengageable from the fork to allow to move from the closed to the open position, and an opening lever coupled to the latch pawl and displaceable between an actuated position displacing the latch pawl out of engagement with the fork and an unactuated position with the latch pawl engageable with the fork. A rotary drive couplable to the opening lever can displace it between its actuated and unactuated positions. In accordance with the invention structure engageable between the fork and the opening lever decouples the opening lever from the drive on displacement of the fork from the open to the closed position.

Thus with this system as the latch is closed, the fork itself mechanically decouples the opening lever from the drive, thereby allowing to move, normally by spring force, back into the unactuated position in which the pawl is again engageable with the fork. As a result the drive can stop when the opening lever is moved into the actuated position, since when the latch is closed the opening lever is decoupled from the drive and moved by its spring back into the unactuated position by the fork. Whatever the drive is doing or whatever position it is in, is irrelevant during the closing operation when the drive is disconnected from the opening lever and locking pawl. Once opened, the door can always be closed and latched, regardless of what the drive is doing. This is in contrast to the prior-art systems where the drive had to cycle somewhat after opening so that if a user immediately closed the door after it opened, the latching would be incomplete or not take place.

According to the invention the drive includes a formation orbital about an axis and the opening lever has a seat open tangentially of the axis and in which the formation is seatable to displace the opening lever from the unactuated position to the actuated position. In addition the drive includes a wheel rotatable about the axis and carrying the formation and an electric motor and gearing connecting the motor to the wheel. With worm gearing a small and very quiet rotary motor can be used to power the latch.

The decoupling structure includes a pin projecting from the opening lever and a cam on the fork. It also includes a cutout lever pivoted on the housing and having formations engageable with the cam of the fork and the pin of the opening lever. These formations include a pin engageable with the cam and a cam edge engageable with the opening-lever pin. Thus the addition of a single one-arm lever to the structure allows the fork to decouple the opening lever from its drive and greatly simplifies and rationalizes operation of the latch.

The spring urging the opening lever into the unactuated position and urging the pawl into engagement with the fork also serves to decouple the seat from the orbital drive formation so that when the decoupling mechanism releases the opening lever, once the latch is closed, the seat is behind the orbital formation and the drive is again clear for movement. Thus a cheap unidirectional motor can be used in the drive.

In accordance with the invention a lost-motion coupling supports the opening lever on the pawl and permits the opening lever to move limitedly relative to the pawl. It includes a slot extending tangentially of the axis and a pin fitting in the slot. The slot is formed according to the invention on the opening lever and the pin is fixed on the pawl.

The housing is provided with a pair of fixed abutments and the opening lever is engaged with one or the other of them in its actuated and unactuated positions. One of these abutment can be a simple stop fixed on the housing and engageable with an end of the opening lever. The other can be the shaft on which the wheel carrying the orbital formation is mounted, since the surface of this shaft, even if it rotates, does not move in the tangential direction the opening lever moves in between its actuated and unactuated positions.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
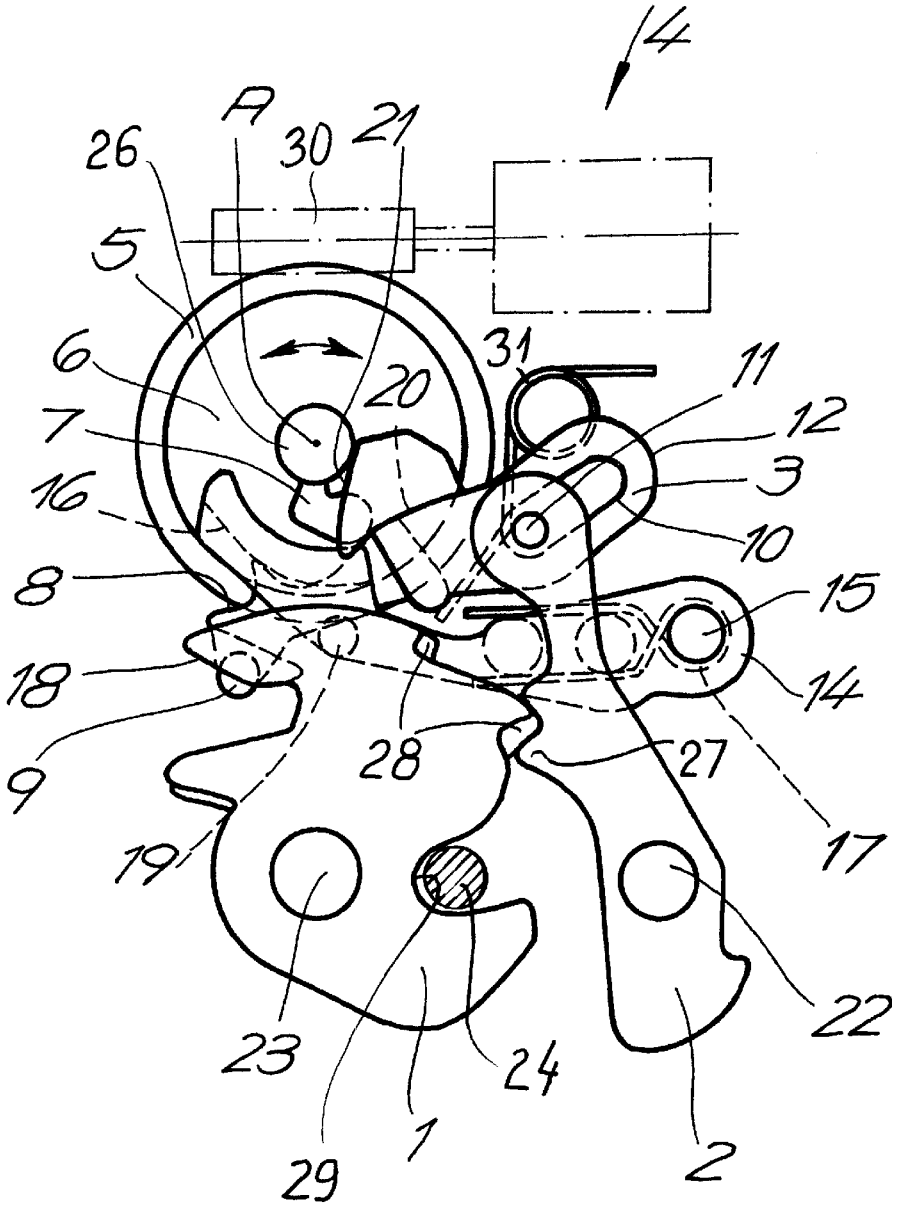
FIG. 1 is a partly diagrammatic side view of the latch according to the invention in the locked position.
Figure 4:
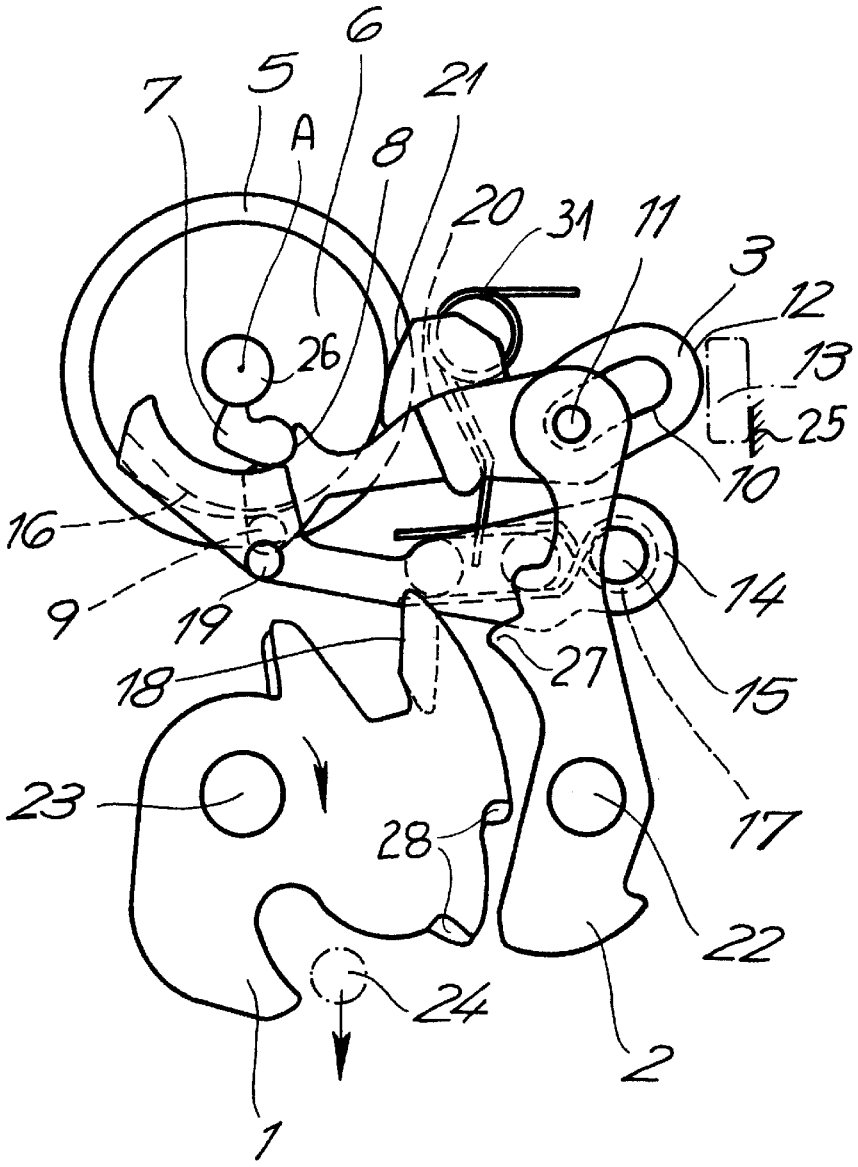

As seen in FIG. 1 a motor-vehicle door latch has a locking element or fork 1 pivoted at 23 on a housing shown schematically at 25 in FIG. 4 and has a pair of teeth 28 and a radially open mouth 29. A bolt 24 extending from an unillustrated door post or trunk-opening edge can be received in the mouth 29 to lock a door or trunk lid carrying the housing 25. A pawl 2 pivoted near its outer end at 22 on the housing 25 has a tooth 27 engageable with the teeth 28 to retain the bolt 1 in the fully locked position of FIG. 1 or a partially locked position as is known per se.

An opening lever 3 is formed at one end with an elongated slot 10 fitting slidably around a pivot pin 11 on the inner end of the pawl 2 and can be moved from right to left as will be described below to pull the tooth 27 out of engagement with the teeth 28 and free the fork 1, the slot 10 and pin 11 forming a lost-motion coupling as will be described below. This shifting of the lever 3 is done by a drive comprised of an electric motor 4 having an output worm 30 engaging a gear wheel 5 carried on a shaft 26 defining an axis A. This shaft 26 also carries a cam wheel 6 formed with an actuating formation or pin 7. Thus the motor 4, which may be reversible, can synchronously rotate the gear 4 and wheel 6 and cause the pin 7 to orbit about the axis A. This opening lever 3 also has an outer end formed with a seat 8 that can fit with the pin 7 on counterclockwise rotation of the wheel 6 and an opposite end 12 engageable with an abutment 13 (FIG. 4) on the housing 25. It also has an arcuate edge 20 directed radially inward toward the axle 26 and a bump 21 that can bear against this axle 26 but not against the pin 7. The lever 3 also carries a closing pin 9 that projects axially away from the wheel 6. A spring 31 urges the lever 3 upward toward the axis A and to the left in FIG. 1.

A linking or cutout lever 14 between the wheel 6 and fork 1 is pivoted on the housing 25 at 15 and has a centering spring 17 that allows it to be deflected to both sides from the illustrated FIG. 1 center position, but that biases it back into this center position. This lever 14 has on one side a radially outwardly directed cam edge 16 that can engage the pin 9 of the lever 3 and carries on its other side a pin 19 projecting away from the wheel 6 and toward the fork 1 and engageable with opposite faces of a cam ridge 18 projecting from the fork 1 toward the wheel 6.

Figure 2:
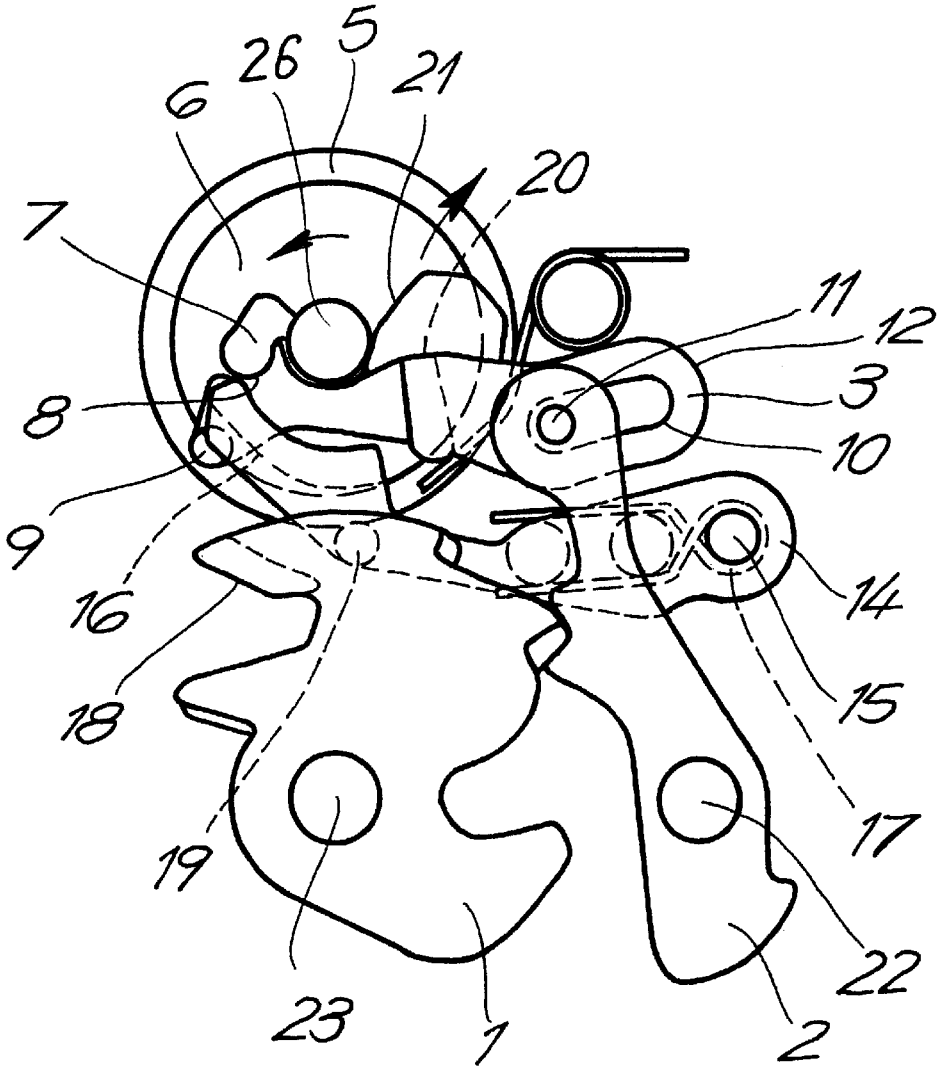
FIGS. 2, 3, and 4 are views like FIG. 1 but showing the latch in progressive positions as it is unlocked.

This latch functions as follows:

Starting from the FIG. 1 locked or starting position, the motor 4 is energized, for instance by tapping an "Open Trunk" button in the vehicle, to rotate the wheel 6 counterclockwise about the axis A and orbit the pin 7 counterclockwise about this axis A. FIG. 2 shows how this action causes the pin 7 to move out of engagement with the surface 20 and allows the spring 31 to pivot the lever 3 up so that the axle 26 is cradled between the surface 20 and the bump 21, in effect forming a fixed abutment defining the unactuated position of the opening lever 3. The pin 9 on the lever 3 comes to bear radially inward on the cam edge 16 of the lever 14.

Figure 3:
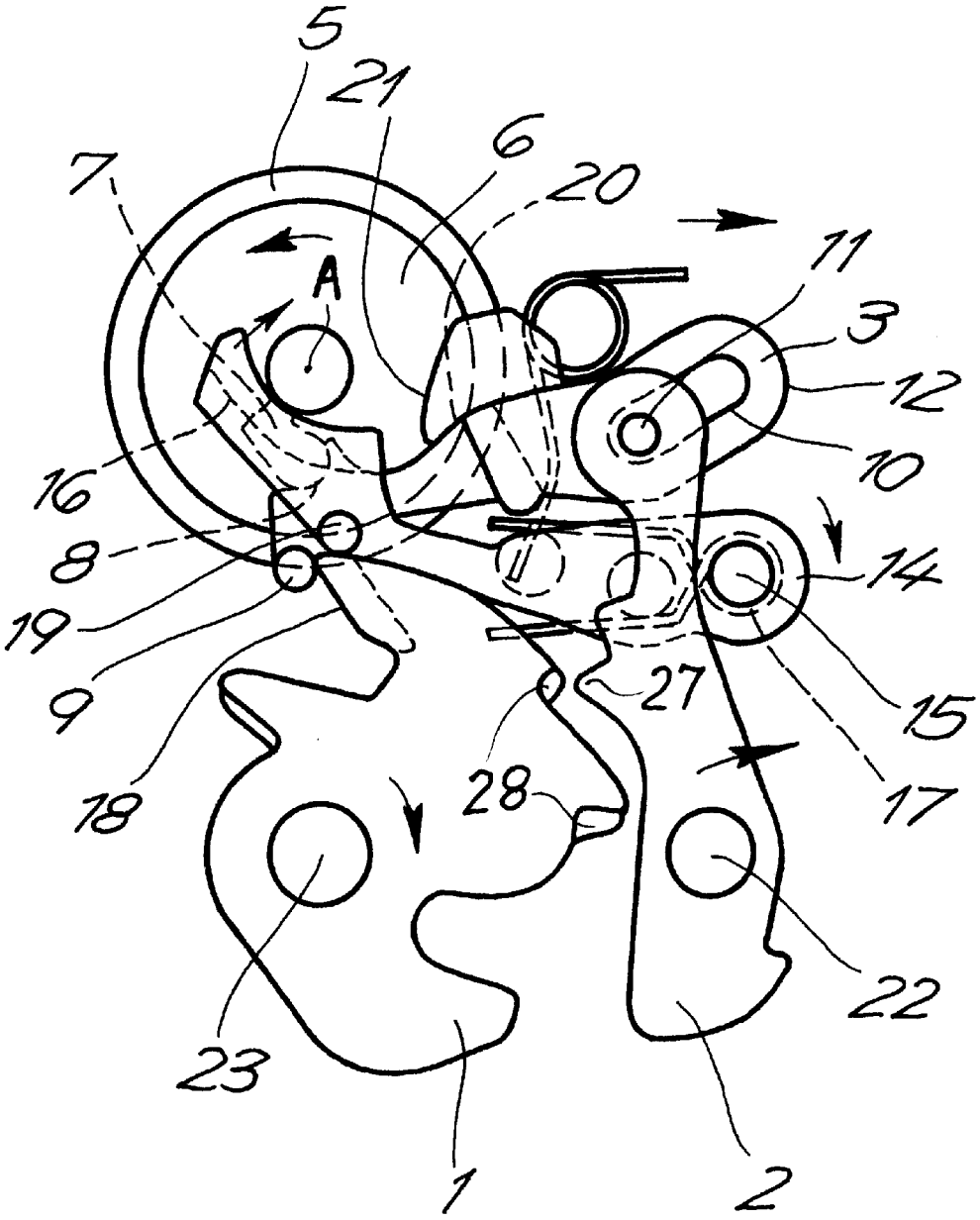

Further counterclockwise rotation as shown in FIG. 3 causes the pin 7, now fitting solidly in the seat 8, to push the lever 3 to the right. This causes the pin 11, which is at the left-hand end of the slot 10, to pivot the pawl 2 counterclockwise and pull its tooth 27 away from the fork 1, thereby freeing the fork 1 to pivot clockwise, normally under the force of an unillustrated torque spring, and release the bolt 24. Meanwhile the cam 18 pushes up the pin 19 to pivot the lever 14 upward into an inner position.

Once the latch is fully opened as shown in FIG. 4, the bolt 24 is released and the door, trunk lid, or the like, springs at least partially open. The end 12 of the lever 3 in its actuated position comes to a stop against the abutment 13, arresting the motor 4, which can have a current monitor that shuts it down when thus arrested. The cam 18 releases the pin 19 so that the spring 17 returns the lever 14 to its center position. This blocking of the opening lever 3 completely ends any noise produced by the latch and its drive and holds the latch in this position.

Figure 5:
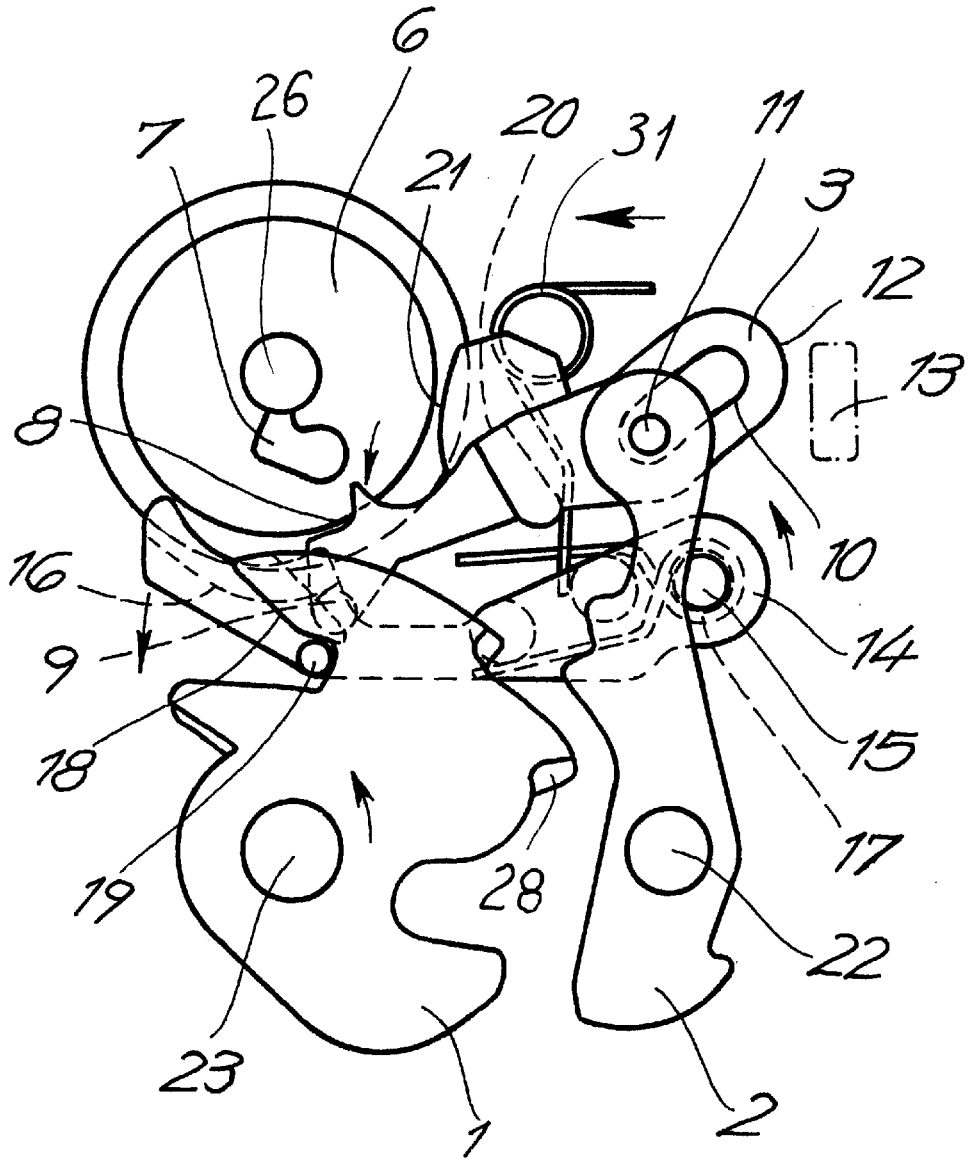
FIG. 5 is a view like FIG. 1 showing the latch at the start of a locking operation.

Then as the trunk lid or door is closed as shown in FIG. 5 the cam 18 engages the pin 18 and pulls it and the lever 14 downward into an outer position. The surface 16 of the lever 14 in turn presses down on the pin 9 and pulls the opening lever 3 down and completely out of contact with the pin 7 and shaft 26. Once thus freed, the lever 3 will of course be moved by the spring 31 back to the left. The cutout lever 14 therefore ensures that during the closing operation the opening lever 3 is held out of contact with the pin 7 and shaft 26 of the drive so that this lever 3 and the pawl 2 are free to swing back under the force of the spring 31.

Figure 6:
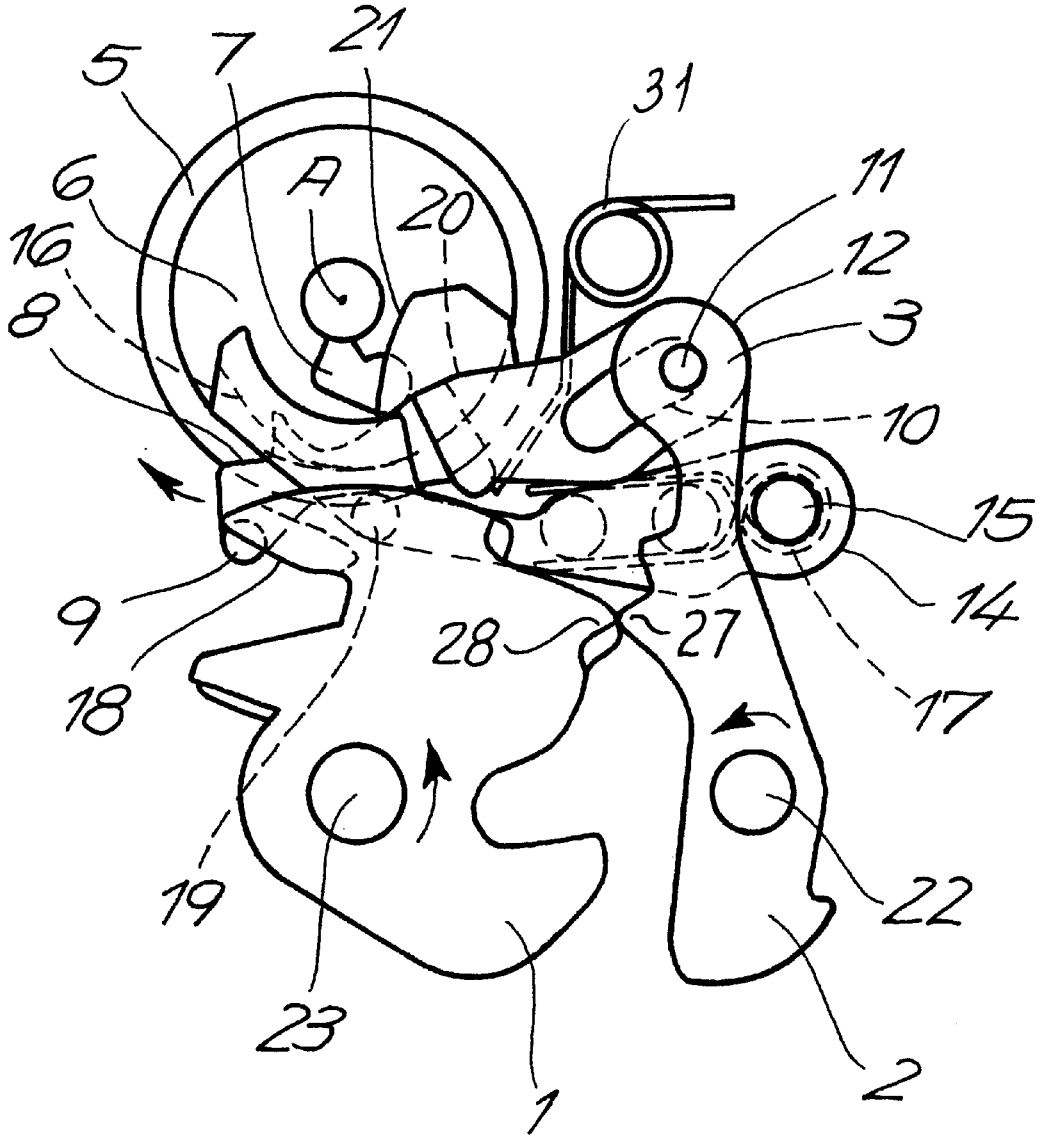
FIG. 6 is a view showing the latch near the end of the locking operation, just before it reassumes the FIG. 1 position.

On further closing movement as shown in FIG. 6, the teeth 28 of the fork 1 pivot the pawl 2 against the force of the spring 31 briefly clockwise, but then this pawl 2 returns clockwise as indicated by the arrow to catch the tooth 27 behind the teeth 28. The pin 19 slips off the end of the cam 18 and the levers 3 and 14 can pivot back in, with the edge 20 resting on the pin 7 but the seat 18 behind the pin 7 which must orbit counterclockwise through at least 180° to fit with it again. Once the fork 1 is pivoted all the way back, the system returns to the FIG. 1 starting position.

I claim:

1. A motor-vehicle door latch comprising:

a housing;

a lock fork pivotal on the housing between open and closed positions;

a latch pawl pivotal on the housing and engageable with the fork in the closed position to retain it therein and disengageable from the fork to allow to move from the closed to the open position;

an opening lever coupled to the latch pawl and displaceable between an actuated position displacing the latch pawl out of engagement with the fork and an unactuated position with the latch pawl engageable with the fork;

rotary drive means couplable to the opening lever for displacing it between its actuated and unactuated positions; and means including structure engageable between the fork and the opening lever for decoupling the opening lever from the drive means on displacement of the fork from the open to the closed position.

2. The motor-vehicle door latch defined in claim 1 wherein the drive includes a formation orbital about an axis and the opening lever has a seat open tangentially of the axis and in which the formation is seatable to displace the opening lever from the unactuated position to the actuated position.

3. The motor-vehicle door latch defined in claim 2 wherein the structure includes a pin projecting from the opening lever and a cam on the fork.

4. The motor-vehicle door latch defined in claim 3 wherein the structure includes a cutout lever pivoted on the housing and having formations engageable with the cam of the fork and the pin of the opening lever.

5. The motor-vehicle door latch defined in claim 4 wherein the cutout-lever formations include a pin engageable with the cam and a cam edge engageable with the opening-lever pin.

6. The motor-vehicle door latch defined in claim 2, further comprising spring means urging the opening lever into the unactuated position and urging the pawl into engagement with the fork.

7. The motor-vehicle door latch defined in claim 6, further comprising a lost-motion coupling supporting the opening lever on the pawl and permitting the opening lever to move limitedly relative to the pawl.

8. The motor-vehicle door latch defined in claim 7 wherein the lost-motion coupling includes a slot extending tangentially of the axis and a pin fitting in the slot.

9. The motor-vehicle door latch defined in claim 8 wherein the slot is formed on the opening lever and the pin is fixed on the pawl.

10. The motor-vehicle door latch defined in claim 2 wherein the drive means includes a wheel rotatable about the axis and carrying the formation.

11. The motor-vehicle door latch defined in claim 10 wherein the drive means further includes an electric motor and gearing connecting the motor to the wheel.

12. The motor-vehicle door latch defined in claim 1 wherein the housing is provided with a fixed abutment and the opening lever is formed with a surface bearing in the actuated position against this abutment.

13. The motor-vehicle door latch defined in claim 1 wherein the housing is provided with fixed abutment and the opening lever has an end bearing in the unactuated position against this abutment.

* * * * *